US008951056B2

(12) United States Patent
Pichot

(10) Patent No.: US 8,951,056 B2
(45) Date of Patent: Feb. 10, 2015

(54) CONNECTOR, IN PARTICULAR FOR UNDERWATER GEOPHYSICAL OPERATIONS

(71) Applicant: Sercel, Carquefou (FR)

(72) Inventor: Yann Pichot, Orvault (FR)

(73) Assignee: Sercel, Carquefou (FR)

( * ) Notice: Subject to any disclaimer, the term of this patent is extended or adjusted under 35 U.S.C. 154(b) by 64 days.

(21) Appl. No.: 13/767,493

(22) Filed: Feb. 14, 2013

(65) Prior Publication Data

US 2013/0210262 A1 Aug. 15, 2013

(30) Foreign Application Priority Data

Feb. 14, 2012 (EP) ..... 12305165

(51) Int. Cl.

| | |
|---|---|
| ***H01R 13/62*** | (2006.01) |
| ***H01R 13/523*** | (2006.01) |
| ***H01R 13/622*** | (2006.01) |
| ***H01R 24/84*** | (2011.01) |

(52) U.S. Cl.

CPC ..... *H01R 13/523* (2013.01); *H01R 13/622* (2013.01); *H01R 24/84* (2013.01)

USPC ..... 439/294

(58) Field of Classification Search

USPC ..... 439/294, 284

See application file for complete search history.

(56) References Cited

U.S. PATENT DOCUMENTS

| | | | | |
|---|---|---|---|---|
| 2,521,822 | A * | 9/1950 | Boswell | 439/294 |
| 3,252,124 | A | 5/1966 | Hansen | |
| 5,120,268 | A | 6/1992 | Gerrans | |
| 6,165,013 | A * | 12/2000 | Broussard | 439/693 |
| 6,447,319 | B1 | 9/2002 | Bodin | |

FOREIGN PATENT DOCUMENTS

| | | |
|---|---|---|
| EP | 0114230 A1 | 8/1984 |
| FR | 2782197 A1 | 11/2000 |
| JP | H02 100211 U | 8/1990 |
| JP | H02100211 U | 8/1990 |

OTHER PUBLICATIONS

European Search Report dated Jun. 20, 2012 from the European Patent Office for corresponding European Patent Application No. 12 30 5165.

* cited by examiner

*Primary Examiner* — Felix O Figueroa
(74) *Attorney, Agent, or Firm* — David D. Brush; Westman, Champlin & Koehler, P.A.

(57) ABSTRACT

A connector is provided, which is configured for being connected to a similar connector. The connector has a global cylindrical shape around a longitudinal axis and includes a connection zone having comprising at least one electrical contact. A housing extends at least partly around the connection zone and has at least two projecting members. A cylindrical locking nut surrounds the housing and is at least partly movable relative to the housing. The housing and the locking nut are configured for respectively cooperating with corresponding locking nut and housing of the similar connector.

14 Claims, 3 Drawing Sheets

CONNECTOR, IN PARTICULAR FOR UNDERWATER GEOPHYSICAL OPERATIONS

CROSS-REFERENCE TO RELATED APPLICATIONS

None.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The present disclosure relates to connectors, for use in a marine environment during underwater operations, for example in the field of the acquisition of seismic data, in particular for oil or gas prospecting industry, marine research or offshore production.

Nowadays, underwater operations are driven using line sections comprising geophysical equipment such as electronic modules, also called nodes.

The line sections are connected to one another by connectors, so as to form an acquisition line of seismic data.

The connectors used to connect these line sections may also contribute to the transfer of electric current and/or data.

Such connectors are designed to support the challenges of shallow water and transition zone seismic operations down to 50 meters. Typically, these connectors are used for underwater operations performed at depths under sea level reaching 75 m, or even more.

Connectors in a submarine environment at such depths are supposed to, simultaneously, be able to resist to mechanical loads and to high pressures due to the depth at which they are used.

BACKGROUND OF THE DISCLOSURE

In the prior art, the connectors connecting two line sections are of several kinds. The strength of the connection is generally improved by screwing of a nut onto a connection portion.

A known kind of connector uses mechanical "back to back" concept, shown in FIG. 1. In the "back to back" concept, the two connectors 98 to be connected together are similar, but there is an additional part 99, the "back to back" part, not belonging to one of the connectors and connected between them with each of them, as shown in the figure. Each of the connectors 98 comprises a connection part 100, exteriorly threaded, and a ring 101, or nut, interiorly threaded so as to be screwed to the connection part 100. The additional part 99 is substantially cylindrical and hollow so as to allow the passage of a portion of the connection parts 100 for carrying out the connection. The additional part 99 comprises, on its external surface, two circular grooves 102. Each ring 101 comprises on its internal surface a corresponding groove 103. The grooves 102 and 103 are to be put one in front of the other, then forming a circular tunnel for housing ball bearing, not shown in the figure.

A drawback of the presence of such additional part is that there are more interfaces between the connectors 98 and the additional part 99 than if there were only two connectors. This increases risks relative to the watertightness of the connection.

Moreover, during operation, said additional part 99 remains connected to one connector 98 which makes the connector 98 not reversible, thereby reducing the productivity of the operation.

Furthermore, as the additional part 99 "back to back" comprises ball bearing, which is likely to be in contact with the environment, in particular with moisture of the seabed. This may cause the jamming of the ball bearing.

Another drawback is that the stiff length of the connectors when connected is longer, due to the presence of the additional part 99. Indeed, when pulling on the cable for bringing it back on the vessel, bending stresses appears on the connector. The more the length of the connector is important, the more the value of these bending stresses is important due to the length of the connector acting like a lever arm.

Another known connector uses the mechanical "back to back" concept, with further an electrical insert. The drawbacks of said connector are similar to the previous one.

Two other known connectors are hermaphrodite, purely symmetrical, with thread locking, but said connectors are not adapted to shallow water operations under the sea level. Indeed, one of these connectors has a floating nut remaining once coupled, which risks to be damaged quite easily. Furthermore, the watertightness of this connector is linked to the screwing made by the operator, which is not secured. The other connector disclosed in FR2782197 has low watertightness and its nuts are too weak to handle marine operations.

SUMMARY

An exemplary embodiment of the present invention relates to a connector, configured for being connected to a similar connector.

According to an embodiment of the invention, the connector has a global cylindrical shape around a longitudinal axis and comprises:

- a connection zone, comprising at least one electrical contact,
- a housing extending at least partly around the connection zone, comprising at least two projecting members of generally cylindrical sector shape,
- a cylindrical locking nut, that may also be called locking ring, surrounding the housing and at least partly movable relative to the housing, the housing and the locking nut being configured for respectively cooperating with corresponding locking nut and housing of said similar connector.

A similar connector means a connector having a similar connection zone, housing and cylindrical locking nut, the connection zone having for example identical or different electrical contact(s). The connector and the similar connector are made to be connected together. The possible other parts of the similar connector, not concerned by the connection between the two connectors, may be identical or different from the corresponding ones of the connector.

In a preferred embodiment, the connector is hermaphrodite and is preferably identical to the similar connector. This means that both connectors have identical connection zones, housings and cylindrical locking nuts, the connection zone having in this case identical electrical contact(s). The connector and the similar connector are made to be connected together. In this case, the possible other parts of the similar connector, not concerned by the connection between the two connectors, may be identical or different from the corresponding ones of the connector.

Thanks to an embodiment of the invention, there is provided a connector whose connection with a similar connector creates a robust and watertight link, able to resist to high pressures of high depths submarine environment thanks in particular to the cooperation between the locking nut of a first connector and the housing of the second connector.

Furthermore, as there is no ball bearing in the connector, there is no risk of jamming.

Moreover, the operator does not lose time during operation, as the two connectors to be connected are preferably identical and as there is no additional part such as the « back to back» part of the prior art.

According to an embodiment of the invention, said at least two projecting members comprise a threaded zone on the outside, i.e. on an outer surface. According to an embodiment of the invention, the locking nut comprises a threaded zone on the inside, i.e. on an inner surface. Said connection by screwing between the two connectors can be carried out manually by the operator for a secured link.

The housing may comprise a total of two projecting members, which in this case may be distributed opposite to one another relative to the longitudinal axis, each of them forming for example one quarter of a cylinder, so as to be able to laterally cooperate with two corresponding projecting members of said similar connector. Such shape of the housing may increase the watertightness of the connection, as two lateral projecting members of two different connectors are laterally in contact with each other.

In an embodiment of the invention, at least one of the projecting members comprises a stop configured for preventing the locking nut from surrounding at least part of the threaded zone of the at least two projecting members. Such stop is useful for limiting the movement of the locking nut along the longitudinal axis in its range of use. In a preferred embodiment, the stop is a stiff stop. The stiff stop allows to manually control the compression by screwing of the locking nut onto the threaded zones, because the stop is visible for the operator using the connector and is stiff. The operator can therefore visually control the compression of the connector at the end of the screwing thanks to the stiff stop(s).

In a particular embodiment, the projecting members each comprise a stop, said stop(s) being located in such a manner that, after connection of the connector to the similar connector, the stops of the projecting members of both connectors create a continuous stop line which contributes to the watertightness of the connection.

At least one of the projecting members comprises a smooth zone, i.e. a zone having a smooth external surface, configured for being laterally put adjacent to a threaded zone of a corresponding projecting member of said similar connector. A smooth zone on a connector (first connector) allows to facilitate the screwing of an adjacent threaded zone of a similar connector (second connector) with the corresponding locking nut on the first connector.

Thus, on a preferred embodiment, there is no thread on the smooth zone to facilitate the screwing of the locking nut on the threaded zone of the corresponding projecting members. Indeed, when the two connectors are assembled, it would be very difficult to match exactly each thread if said smooth zone also had a threaded zone.

The length of the threaded zone and the length of the smooth zone along the longitudinal axis are for example substantially equal so that the stops of two laterally cooperating projecting members of the connector and of the similar connector are aligned when connected. Such feature may also enable the creation of the stop line made by the stops adjacent to one another and improves the watertightness of the connection.

The smooth zone of the projecting members may be arranged to be surrounded by the locking nut at least when the connector is connected to the similar connector.

In another embodiment, at least one smooth zone is replaced by a second threaded zone so as to improve the locking of the two connectors by increasing the threaded surface.

The connection zone and the housing are advantageously symmetrical about the longitudinal axis.

The connector may be made of at least one material consisting of a metal, such as a corrosion free metal. Said material is adapted to resist to the submarine environment, even at high depths under the sea level.

The connection zone comprises at least one female electrical contact and one male electrical contact, preferentially a plurality of female electrical contacts and a plurality of male electrical contacts. The position of the electrical contacts is such as to make the connector a hermaphrodite connector, in the preferred embodiment.

The connector may comprise an end opposite to the connection zone and may be connected to a cable at said end. Said cable is part of the line section comprising cables linking nodes or geophysical equipment.

In an embodiment, the locking nut rotates freely around the longitudinal axis and is at least partly movable along the longitudinal axis when not connected to the at least two projecting members of said similar connector. Said movement allows the connection, for example by screwing, of the locking nut to the housing of the similar connector when necessary.

The connector may comprise a second stop for preventing the locking nut from going beyond a predetermined limit when it is not connected to the at least two projecting members of said similar connector. Such second stop is useful for keeping the locking nut in the vicinity of the housing.

The connector of an embodiment of the present invention may be arranged for being used in underwater geophysical operation, for example for use at depths under sea level that may reach 75 m, or even more.

Another embodiment of the invention provides an assembly of two connectors as described above, connected to one another.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF AN EXEMPLARY EMBODIMENT

Figure 1:
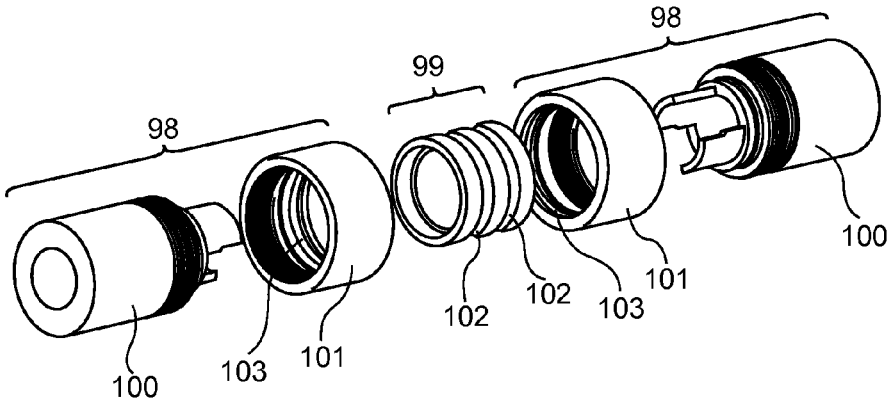
Fig. 1 PRIOR ART
FIG. 1 illustrates a connector of the "back to back" concept of prior art.
Figure 2:
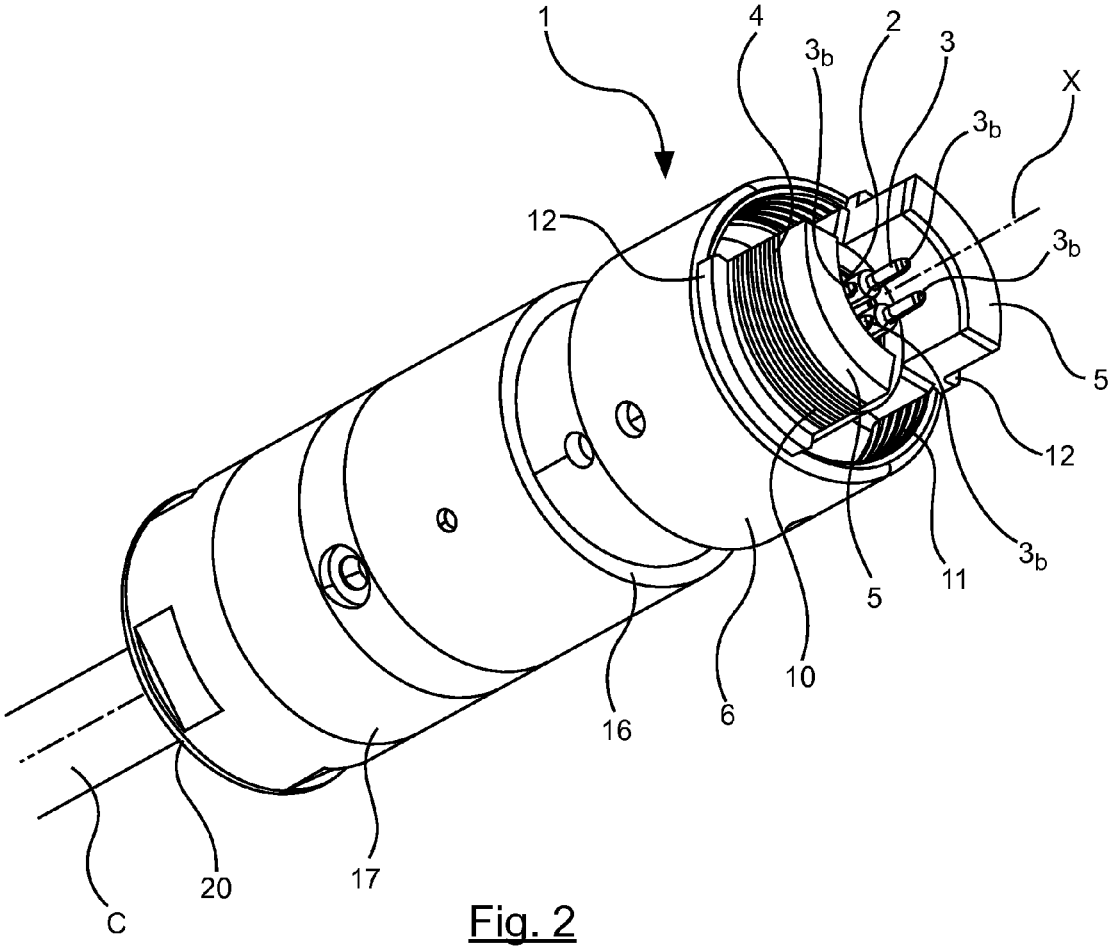
FIG. 2 is a schematic view in perspective of a connector according to an embodiment of the invention.

FIG. 2 shows a connector 1 according to an embodiment of the invention, for use in underwater geophysical operation, for example at 75 m under seabed, or even more.

The connector 1 shown in the figures is a hermaphrodite connector configured for being connected to a similar connector, which is, in this embodiment an identical connector.

According to an embodiment of the invention, the connector 1 has a global cylindrical shape around a longitudinal axis X.

The connector 1 comprises:

- a connection zone 2, comprising at least one electrical contact 3,
- a housing 4 extending at least partly around the connection zone 2, comprising two projecting members 5 of generally cylindrical sector shape,
- a cylindrical locking nut 6 surrounding the housing 4.

According to an embodiment of the invention, the housing 4 and the locking nut 6 are configured for respectively cooperating with corresponding locking nut 6 and housing 4 of the similar connector 1.

In this embodiment, the locking nut 6 rotates freely around the longitudinal axis X and is at least partly movable along the longitudinal axis X, before connection.

In the embodiment shown, the connection zone 2 and the housing 4 are both symmetrical about the longitudinal axis X. The connection zone 2 comprises in this example four female electrical contacts 3*a* (not visible in FIG. 2) and four male electrical contacts 3*b*. The number, shape and position of the electrical contacts 3 are such as to make the connector 1 a hermaphrodite connector, in this embodiment.

The connector is made of at least one stiff material consisting of a corrosion free metal. Said material is adapted to resist to the submarine environment, even at high depths under the sea level, in particular to resist to high pressures and to corrosion.

The two projecting members 5 are distributed opposite to one another, as shown. Each of them forms in this example one quarter of a cylinder, so as to be able to laterally cooperate with two corresponding projecting members of the similar connector. In this embodiment, the housing 4 therefore comprises two quarters of a cylinder being occupied by the projecting members 5, symmetrically disposed about the longitudinal axis X, and two other quarters without anything for housing two projecting members 5 of a similar connector, also disposed symmetrically about the longitudinal axis X. The four quarters are angularly equal, each occupying an angle of 90° of the circle.

The two projecting members 5 comprise an outer threaded zone 10 and the locking nut 6 comprises an inner threaded zone 11. As shown, the threaded zone 11 of the locking nut 6 occupies the whole inner circumference of the locking nut 6.

The projecting members 5 further comprise stops 12 configured for preventing the locking nut 6 from surrounding at least part of the threaded zone 10 of the at least two projecting members 5. The stops 12 are in this example formed by a shoulder extending on the outer circumference of the projecting members 5, next to the threaded zone 10 of the projecting members 5. Such stops 12 are useful for limiting the movement of the locking nut 6 along the longitudinal axis X.

The connector 1 comprises an end 20 opposite to the connection zone 2, At this end 20, the connector 1 is connected to a cable C. Said cable C is part of the line section comprising cables C linking nodes or geophysical equipments, not shown.

The connector 1 comprises a second stop 16 for preventing the locking nut 6 from going beyond a predetermined limit when it is not connected to the at least two projecting members 5 of the similar connector 1. Such second stop 16 is useful for keeping the locking nut 6 in the vicinity of the housing 4.

The connector 1 comprises a cylindrical base 17, formed between the housing 4 and the end 20, which presents a shoulder forming the second stop 16, in this example.

According to an embodiment, the connector 1 is made of at least one material consisting of a metal, such as a corrosion free metal, for example stainless steel or titanium.

Figure 3:
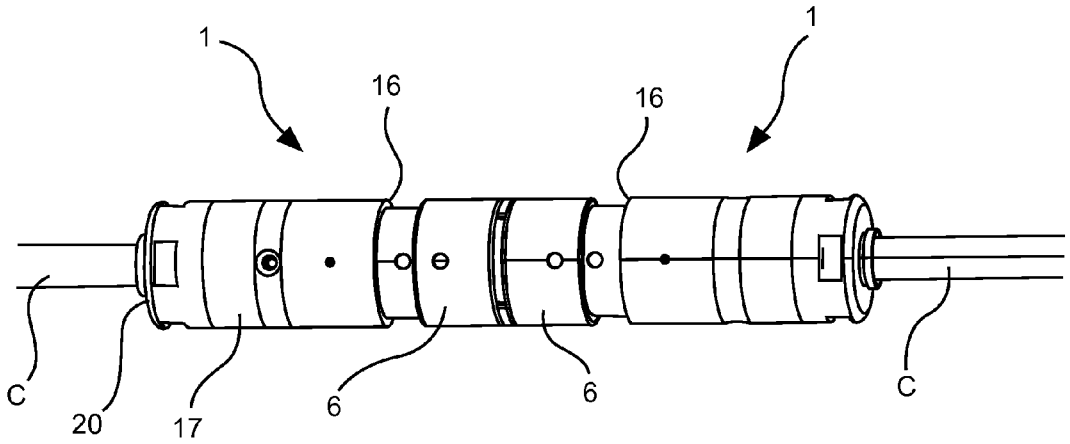
FIG. 3 is a schematic view in perspective of two connectors as the one of FIG. 1 connected together.
Figure 4:
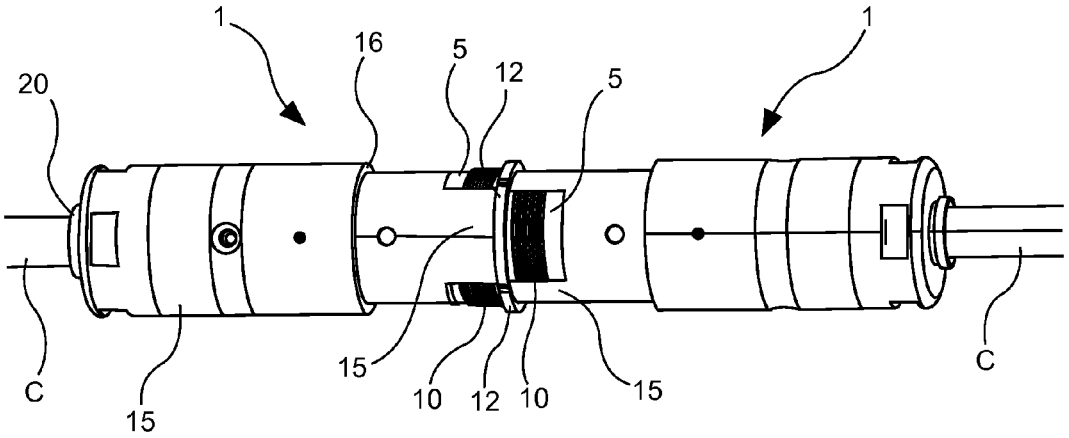
FIG. 4 is a schematic view of the two connected connectors of FIG. 2, without representation of the locking nuts.

FIGS. 3 and 4 show two connectors 1 connected together.

In FIG. 3, the locking nuts 6 of each connector 1 have been screwed to the projecting members 5 of the other connector 1, thanks to the cooperation of the threading zones 10 and 11. The threaded zone 10 of the projecting members 5 are therefore not visible.

In FIG. 4, the locking nuts 6 have not been represented so that the threaded zones 10 of the projecting members 5 are visible.

In this embodiment, the projecting members 5 each comprise the stop 12, said stop(s) being located in such a manner that, after connection of the connector 1 to the similar connector 1, and as shown in FIGS. 3 and 4, the stops 12 of the projecting members 5 of both connectors 1 create together a continuous stop line, which contributes to the water-tightness of the connection.

As visible in FIG. 4, each of the projecting members 5 comprises a smooth zone 15. The smooth zones 15 are configured for being laterally put adjacent to a threaded zone 10 of a corresponding projecting member 5 of the similar connector 1.

The smooth zone 15 is not visible in FIG. 2 as it is hidden by the locking nut 6. The reason is that the smooth zones 15 of the projecting members 5 are arranged to be surrounded by the locking nut 6 at least when the connector 1 is connected to the similar connector. In FIG. 2, although the connectors 1 are not connected together, the locking nut 6 is in position as if it where screwed to the projecting members 5 of the similar connector 1.

The length of the threaded zone 10 and the length of the smooth zone 15 along the longitudinal axis X are in this example substantially equal so that the stops 12 of two laterally cooperating projecting members 5 of the connector 1 and of a similar connector 1 are almost aligned when connected, as can be seen in FIG. 4, for creating the aforementioned stop line. Indeed, the stops 12 are slightly staggered when the two connectors are connected, so as to make sure that the locking nut 6 of a first connector 1 is tighten against the stop 12 of the second connector 1 and not against the stop 12 of the first connector 1. The stiff stops 12 allow the operator to manually control the compression by screwing of the locking nuts 6 onto the threaded zones 10, because the stops 12 are visible for the operator connecting the connectors 1 and are stiff.

A smooth zone 15 on a connector 1 (first connector) allows to facilitate the screwing of an adjacent threaded zone of a similar connector 1 (second connector) with the corresponding locking nut 6 on the first connector.

On a preferred embodiment, there is no thread on the smooth zone to facilitate the screwing of the locking nut on the threaded zone of the corresponding projecting members. Indeed, when the two connectors are assembled, it would be very difficult to match exactly each thread if said smooth zone had a threaded zone.

In another embodiment not shown, at least one smooth zone 15 is replaced by a second threaded zone so as to improve the locking of the two connectors by increasing the threaded surface. But this configuration is very hard to implement because of the aforementioned difficulties to match side by side two threaded zones.

The stiff length of the connector of an embodiment of the present invention is shorter than a the length of the "back to back" connector of the prior art. Indeed, there is no additional part, the length of the stiff length is shorter, and thus allows to reduce the bending stresses when pulling on the cable for bringing it back on the vessel.

Indeed, when pulling on the cable for bringing it back on the vessel, bending stresses appears on the connector. The more the length of the connector is important, the more the value of these bending stresses is important due to the length of the connector acting like a lever arm. The connector of an embodiment of the present invention is therefore more durable than a connector of the prior art.

Figure 5:
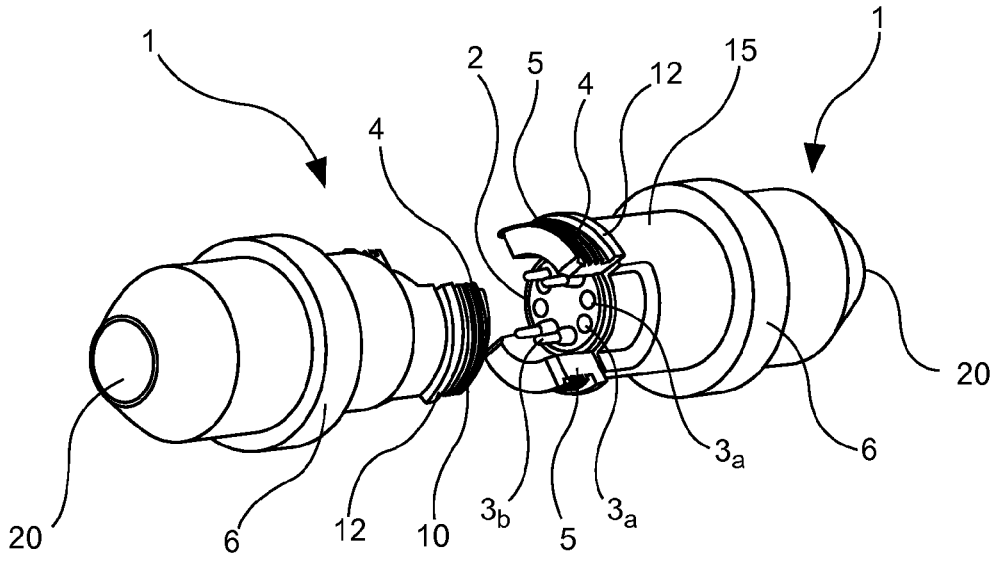
FIGS. 5 and 6 are schematic views in perspective of two connectors according to an embodiment of the invention, respectively represented before and during connection.
Figure 6:
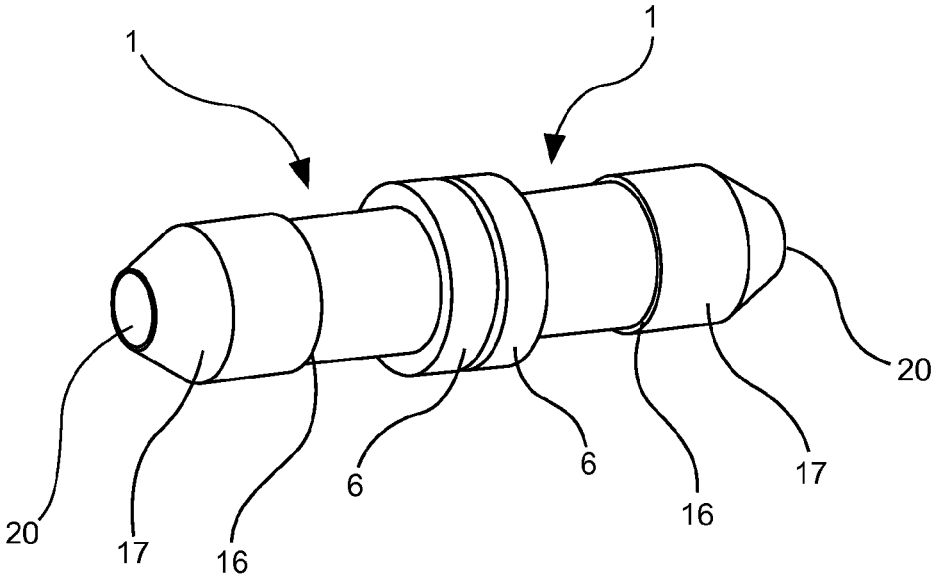

FIGS. 5 and 6 are schematic views in perspective of two connectors according to an embodiment of the invention.

In FIG. 5, the connectors 1 are not connected together, and in FIG. 6, they are connected.

In FIG. 5, one can see the four male electrical contacts 3*b* and the four female electrical contacts 3*a*, being symmetrically disposed around the longitudinal axis X. In this example, the male electrical contacts 3*b* are disposed in the connection zone 2 close to the projecting members 5, and the female electrical contacts 3*a* are disposed close to the quarter of cylinders deprived of projecting members. The female and male electrical contacts are disposed in the connection zone in such a manner that a circle could link the bases of the electrical contacts 3*a* and 3*b*.

It is to be noted that the connection between two connectors 1 takes place in two steps. Firstly, the connectors 1, disposed such that the connection zones 2 are face to face, turned of 90° with respect to the other, as shown in FIG. 5, are connected by the operator. The result is shown in FIG. 4, each projecting member 5 being in contact with its two adjacent projecting members 5. The stops 12 form an interface. Then, secondly, the locking nuts 6 are displaced and screwed by the operator around the projecting members 5 so as to realize a watertight and robust link between the two connectors 1. The stops 12 form the limit of screwing of the locking nuts 6 and enable a control of the compression applied to the connection. The two locking nuts 6 surround the projecting members 5 of the connectors 1, so that the zones of contact between two adjacent projecting members 5 are covered by the locking nuts 6, improving the water-tightness of the connection.

The patentable scope of the subject matter is defined by the claims, and may include other examples that occur to those skilled in the art. Such other examples are intended to be within the scope of the claims.

The expression « comprising a» should be interpreted as being synonymous of the expression « comprising at least one» , unless the contrary is specified.

An exemplary embodiment provides a connector, such as hermaphrodite, for underwater operations, especially for shallow water operations, which provides reversible sections to connect equally.

More particularly, an embodiment provides such a connector which coupling with a similar connector is water-tightness, even at high depths under the sea level such as 75 m under the sea level.

An embodiment provides such a connector which coupling with a similar connector relies on a controlled connection which ensures a robust link between the connectors.

An embodiment provides a connector shorter than the connector of the « back to back» kind.

Although the present disclosure has been described with reference to one or more examples, workers skilled in the art will recognize that changes may be made in form and detail without departing from the scope of the disclosure and/or the appended claims.

The invention claimed is:

1. A connector configured for being connected to a similar connector, wherein the connector comprises:

a global cylindrical shape around a longitudinal axis, a connection zone, comprising at least one electrical contact, a housing extending at least partly around the connection zone, comprising at least two projecting members of generally cylindrical sector shape, and a cylindrical locking nut surrounding the housing and at least partly movable relative to the housing, wherein the housing and the locking nut are configured for respectively cooperating with a corresponding locking nut and housing of said similar connector, wherein said at least two projecting members comprise a threaded zone on an outside and wherein at least one of the projecting members comprises a stop configured for preventing the locking nut from surrounding at least part of the threaded zone of the at least two projecting members, wherein said stop is located in such a manner that, after connection of the connector to the similar connector, the stops of the projecting members of both connectors create a continuous stop line which contributes to water-tightness of the connection.

2. The connector according to claim 1, being hermaphrodite and identical to the similar connector.

3. The connector according to claim 1, wherein the locking nut comprises a threaded zone on an inside.

4. The connector according to claim 1, wherein the housing comprises a total of two projecting members, which are distributed opposite to one another, each of them forming one quarter of a cylinder, so as to be able to laterally cooperate with two corresponding projecting members of said similar connector.

5. The connector according to claim 1, wherein at least one of the projecting members comprise a smooth zone configured for being laterally put adjacent to a threaded zone of a corresponding projecting member of said similar connector.

6. The connector according to claim 5, wherein a length of the threaded zone and the length of the smooth zone along the longitudinal axis are substantially equal so that the stops of two laterally cooperating projecting members of the connector and of the similar connector are aligned when connected.

7. The connector of claim 5, wherein the smooth zone of the projecting members is configured to be surrounded by the locking nut at least when the connector is connected to the similar connector.

8. The connector according to claim 1, wherein the connection zone and the housing are symmetrical about the longitudinal axis.

9. The connector according to claim 1, being made of at least one material consisting of a metal.

10. The connector according to claim 1, wherein the connection zone comprises a plurality of female electrical contacts and a plurality of male electrical contacts.

11. The connector according to claim 1, comprising an end opposite to the connection zone and being connected to a cable at said end.

12. The connector according to claim 1, wherein the locking nut rotates freely around the longitudinal axis and is at least partly movable along the longitudinal axis when not connected to the at least two projecting members of said similar connector.

13. The connector according to claim 1, comprising a second stop configured to prevent the locking nut from going beyond a predetermined limit when it is not connected to the at least two projecting members of said similar connector.

14. The connector according to claim 1, wherein the connector is configured for being used in underwater geophysical operation.

* * * * *